US007971273B2

(12) United States Patent
Grilliot et al.

(10) Patent No.: US 7,971,273 B2
(45) Date of Patent: Jul. 5, 2011

(54) DRAG HARNESS WITH MULTIPLE GRIPPING LOCATIONS

(75) Inventors: William L. Grilliot, Dayton, OH (US); Mary I. Grilliot, Dayton, OH (US); Patricia K. Waters, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 108 days.

(21) Appl. No.: 11/805,982

(22) Filed: May 25, 2007

(65) Prior Publication Data

US 2008/0289089 A1 Nov. 27, 2008

(51) Int. Cl.
*A41D 13/00* (2006.01)

(52) U.S. Cl. ..... 2/81; 2/69; 2/227

(58) Field of Classification Search ..... 2/455, 458, 2/310, 329, 331, 69, 81, 94, 79, 227, 97, 2/69.5, 456, 305; 182/3–7; 244/143, 151 R
See application file for complete search history.

(56) References Cited

U.S. PATENT DOCUMENTS

| | | | | | |
|---|---|---|---|---|---|
| 2,979,153 | A * | 4/1961 | Hoagland et al. | 182/3 |
| 3,074,074 | A * | 1/1963 | Lovering | 2/94 |
| 3,973,643 | A * | 8/1976 | Hutchinson | 182/3 |
| 4,449,253 | A * | 5/1984 | Hettinger | 2/93 |
| 4,599,750 | A * | 7/1986 | Rahaman | 2/243.1 |
| 4,682,671 | A * | 7/1987 | Hengstenberger et al. | 182/3 |
| 4,854,418 | A * | 8/1989 | Hengstenberger et al. | 182/3 |
| 5,136,724 | A * | 8/1992 | Grilliot et al. | 2/81 |
| 5,289,590 | A * | 3/1994 | Larson | 2/227 |
| 5,361,418 | A * | 11/1994 | Luzenske | 2/338 |
| 5,799,328 | A * | 9/1998 | Harlem et al. | 2/69 |
| 5,970,517 | A * | 10/1999 | Jordan | 2/69 |
| 6,035,440 | A * | 3/2000 | Woodyard | 2/102 |
| 6,101,631 | A * | 8/2000 | Ferguson, Jr. | 2/94 |
| 6,167,572 | B1 * | 1/2001 | Naumovitz | 2/227 |
| 6,205,584 | B1 * | 3/2001 | Yocco | 2/69 |
| 6,256,789 | B1 * | 7/2001 | Young et al. | 2/69 |
| 6,343,383 | B1 * | 2/2002 | Madorma-Williams | 2/227 |
| 6,397,389 | B1 * | 6/2002 | Schultz | 2/69 |
| 6,658,666 | B2 * | 12/2003 | Schweer | 2/94 |
| 6,662,372 | B2 * | 12/2003 | Lewis et al. | 2/69 |
| 7,003,810 | B2 * | 2/2006 | Goldkind | 2/227 |
| 7,047,567 | B2 * | 5/2006 | Allen | 2/69 |
| 7,331,836 | B1 * | 2/2008 | Harris | 441/88 |
| 2004/0004367 | A1 * | 1/2004 | Main et al. | 294/150 |
| 2005/0173188 | A1 * | 8/2005 | Lewis et al. | 182/3 |
| 2007/0044197 | A1 * | 3/2007 | Turcotte et al. | 2/69 |
| 2007/0169246 | A1 * | 7/2007 | Sloan et al. | 2/81 |
| 2007/0192926 | A1 * | 8/2007 | Fee et al. | 2/81 |
| 2007/0199135 | A1 * | 8/2007 | Grilliot et al. | 2/311 |

* cited by examiner

*Primary Examiner* — Katherine Moran
*Assistant Examiner* — Richale L Quinn
(74) *Attorney, Agent, or Firm* — Wood, Phillips, Katz, Clark & Mortimer

(57) ABSTRACT

A drag harness for use with a protective garment for a fire fighter or emergency worker is provided. The protective garment includes an outer shell having a main body portion and at least two limb covering portions. The drag harness includes a wearer loop and at least two gripping portions. A first gripping portion is located at a first limb covering portion while a second gripping portion is located at a second limb covering portion. Each of the gripping portions is located adjacent the outer shell in a non-deployed state and extend away from the outer shell in a deployed state whereby a rescuer can drag a wearer.

26 Claims, 2 Drawing Sheets

DRAG HARNESS WITH MULTIPLE GRIPPING LOCATIONS

FIELD OF THE INVENTION

This invention pertains to a protective garment such as for a firefighter or emergency worker, and in more particular applications, to a protective garment having including a drag harness.

BACKGROUND OF THE INVENTION

Commonly, a firefighter or an emergency worker wears a protective garment, such as a protective coat. Furthermore, firefighters or emergency workers also wear additional safety equipment, such as drag harnesses, such that the wearer can be dragged and/or carried by a rescuer should the wearer become incapacitated. These drag harnesses can be worn within or on the exterior of the of the protective garment.

Protective garments and drag harnesses have generally been configured to have a pull strap located behind the head of the wearer. In this form, the pull strap can be extended from the protective garment to drag the wearer should the wearer become injured or incapacitated. However, firefighters and emergency workers carry bulky and heavy equipment which makes it difficult to drag the firefighter or emergency worker. Furthermore, the rescuer may have to travel over unsteady ground which makes it difficult to stabilize the wearer.

SUMMARY OF THE INVENTION

In one form, a protective garment for a firefighter or emergency worker is provided. The protective garment includes an outer shell and a drag harness. The outer shell has a main body portion and at least two limb covering portions. The drag harness is located substantially within the outer shell. The drag harness includes a wearer portion and at least two gripping portions. A first gripping portion is located at a first limb covering portion and a second gripping portion located at a second limb covering portion. Each of the gripping portions is located adjacent the outer shell in a non-deployed state and extend away from the outer shell in a deployed state whereby a rescuer can drag a wearer.

According to one form, a protective garment for a firefighter or emergency worker is provided. The protective garment includes an outer shell and a drag harness. The outer shell has a center line which defines two halves. The drag harness is located substantially within the outer shell. The drag harness includes a wearer loop and at least two gripping portions. A first gripping portion is located at one of the halves while a second gripping portion is located at the other of the halves. Each of the gripping portions includes a gripping loop located adjacent the outer shell in a non-deployed state and extend away from the outer shell in a deployed state whereby a rescuer can drag a wearer, each gripping loop being a separate loop that is connected to the wearer portion.

In one form, the outer shell includes a first set of apertures and a second set of apertures.

According to one form, the first gripping portion passes out of the outer shell through a first one of the first set of apertures and back into the outer shell through a second one of the first set of apertures while the second gripping portion passes through a first one of the second set of apertures and back into the outer shell through a second one of the first set of apertures.

In one form, each of the apertures is defined by a grommet located on the outer shell.

According to one form, the drag harness comprises a webbing material.

In one form, the drag harness comprises a rope material.

According to one form, the drag harness further includes a releasable fastener whereby the drag harness can be secured around a wearer.

In one form, the garment is a protective coat having arm covering portions and the gripping portions extend from the arm covering portions.

In one form the garment is a protective coat having shoulder covering portions and the gripping portions extend from the shoulder covering portions.

According to one form, the garment is protective pants or coveralls having leg covering portions, the drag harness further comprising two wearer portions, one each within the leg covering portions and the gripping portions extend form the leg covering portions.

In one form, the protective garment further includes an additional gripping portion extending from the main body portion.

According to one form, the additional gripping portion is a pull strap.

Other objects, features, and advantages of the invention will become apparent from a review of the entire specification, including the appended claims and drawings.

DETAILED DESCRIPTION OF THE ILLUSTRATED EMBODIMENT

Figure 1:
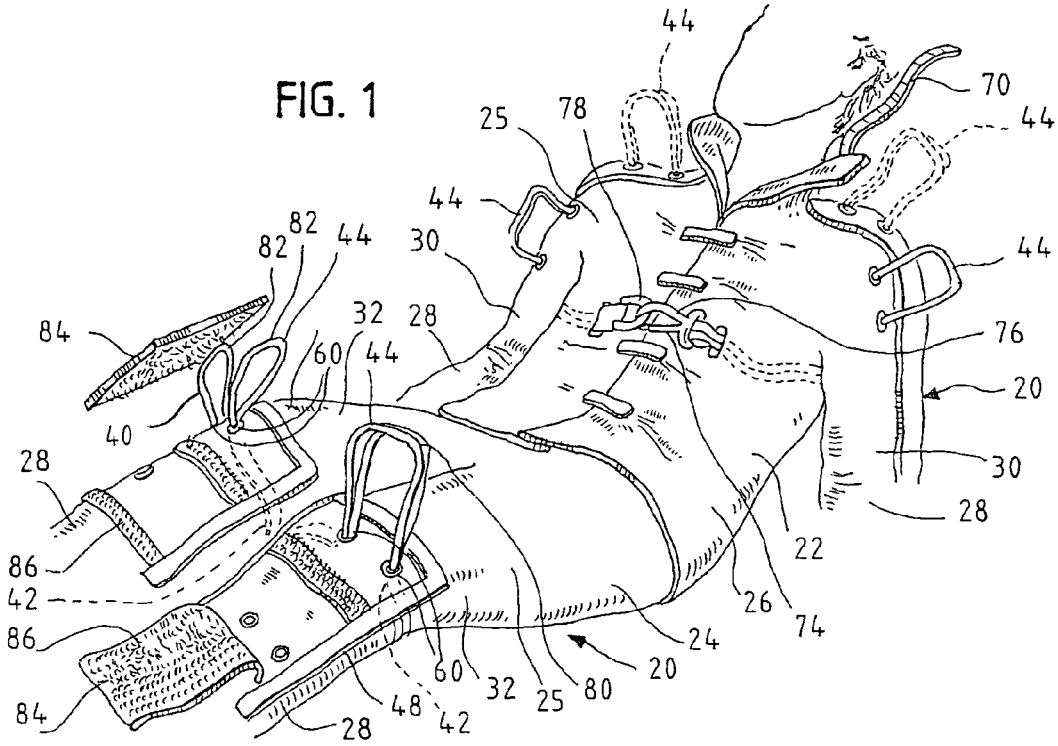
FIG. 1 is a perspective view of a firefighter wearing multiple protective garments and drag harnesses.
Figure 2:
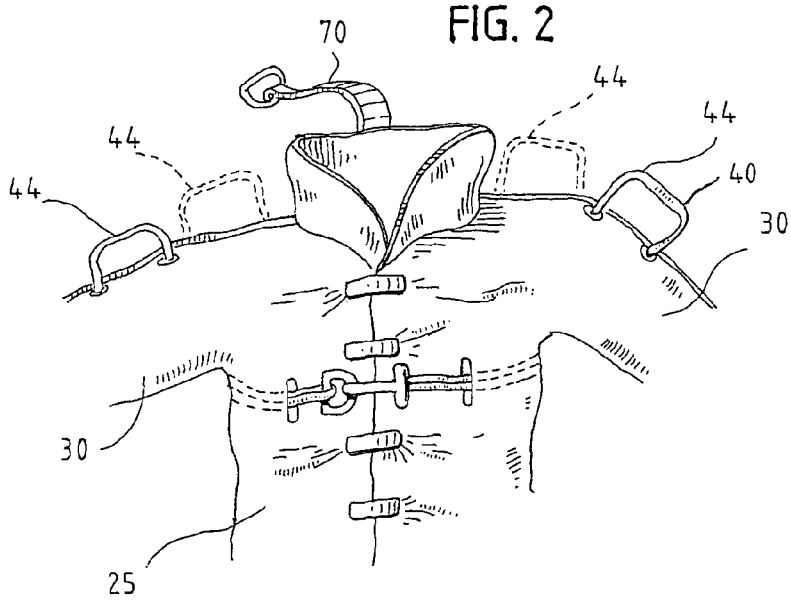
FIG. 2 is a front perspective view of a protective coat and drag harness.

As illustrated in FIG. 1, multiple protective garments 20 are shown, including a protective coat 22 and protective pants or coveralls 24. The protective garment 20 may be similar to many conventional types of protective garments known to those skilled in the art and therefore those common features will not be discussed in detail herein. For example, the protective garment may include a protective outer shell and one or more thermal and/or water resistant liners. As described herein the protective garment 20 includes additional features which will be detailed below. Furthermore, it should be understood that these additional features may be added to many forms of existing protective garments such that the garment may be retro-fit to accommodate the additional features.

Figure 3A:
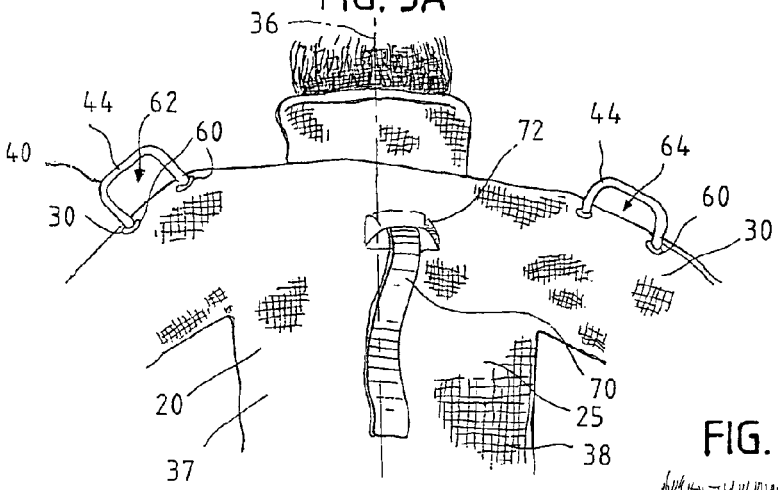
FIG. 3A is a rear perspective view of one embodiment of a protective coat and drag harness.
Figure 3B:
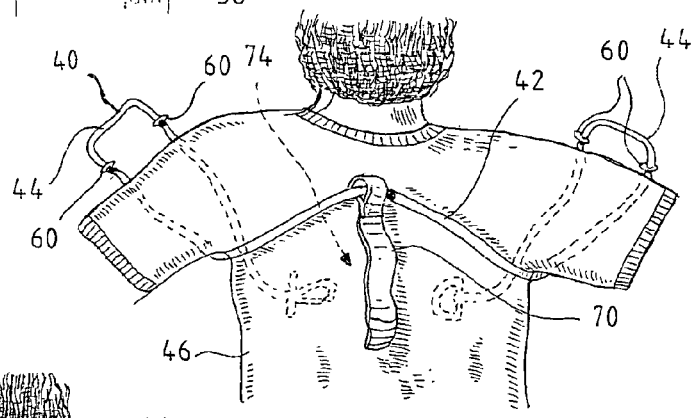
FIG. 3B is a rear perspective view of the drag harness of FIG. 3A.
Figure 4A:
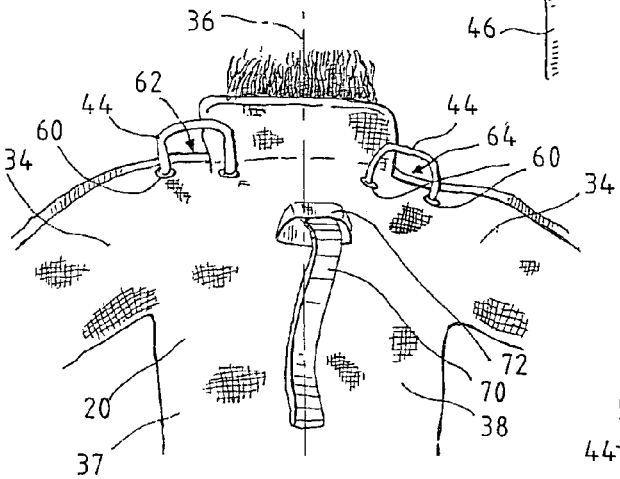
FIG. 4A is a rear perspective view of an alternative embodiment of a protective coat and drag harness.

The protective garment 20 includes an outer shell 25 having a main body portion 26 and at least two limb covering portions 28. Referring to FIG. 1, the protective coat 22 includes arm covering portions 30 while the protective pants 24 include leg covering portions 32. Furthermore, the protective coat 22 includes shoulder covering portions 34, as best seen in FIG. 4A. It should be noted that the protective pants 24 also include a main body portion 26 which is obstructed from view by the protective coat 22, as shown in FIG. 1. Referring to FIGS. 3A and 3B, the protective garment 20 includes a center line 36, which may or may not be a visible line, that defines two halves 37, 38, with at least one of the limb covering portions 28 being located on each of the halves 37, 38.

The protective garment 20 includes a drag harness 40 located substantially within the outer shell 25. The drag harness 40 may take a variety of forms, such as shown in the embodiments in FIGS. 3B and 4B. The drag harness 40 includes a wearer portion 42 and at least two gripping portions 44. Generally, the wearer portion 42 substantially encircles a portion of the wearer. For example, where the drag harness 40 is used with a coat 30, the wearer portion 42 substantially encircles the wearer's torso 46. Where the drag harness 40 is used with pants 32, the wearer portion 42 substantially encircles the wearer's leg 48.

Figure 4B:
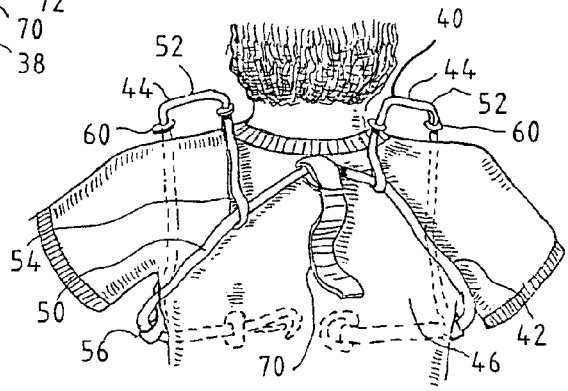
FIG. 4B is a rear perspective view of the drag harness of FIG. 4A.

Furthermore, it should be understand that the drag harness 40 may be made from a single length of material, as shown in FIGS. 3A and 3B. In this embodiment, the wearer portion 42 and the gripping portions 44 are contiguous such that the gripping portions 44 interrupt the wearer portion 42. Alternatively, as shown in FIGS. 4A and 4B, the gripping portions 44 are made from separate material and may be attached to the wearer portion 42. In this embodiment, the wearer portion 42 may be more accurately described as a wearer loop 50 as the wearer loop 50 encircles the wearer's torso 46 uninterrupted by the gripping portions 44.

Furthermore, in this embodiment, the gripping portions 42 may be more accurately described as gripping loops 52 whereby each gripping loop 52 includes a first end 54 operably coupled to the wearer loop 50 and a second end 56 operably coupled to the wearer loop 50 remote from the first end 54. The gripping loops 52 are operably coupled to the wearer loop 50 in a variety of manners. In one form, the first and second ends 54, 56 are affixed directly to the wearer loop 50 such as by sewing, riveting and the like. In another form, the first and second ends 54, 56 slidably engage the wearer loop 50 such that the ends 54, 56 are permitted to move along the wearer loop 50. In this form, the gripping loops 52 can be added to a preexisting drag harness (not shown) to thereby retro-fit the drag harness (not shown). For example, the ends 54, 56 can each be sewn to form loops, as shown in FIG. 4B to thereby slidably couple with the wearer loop 50. In another example, the ends 54, 56 include apertures (not shown) whereby the wearer loop 50 may pass through the ends 54, 56. Other forms to operably couple the gripping loops 52 to the wearer loop 50 are also contemplated as understood by those skilled in the art.

The gripping portions 42 extend through the outer shell 25, such as through apertures 60. The apertures 60 may be defined by structure such as grommets and the like, or may simply be an opening formed through the material of the outer shell 25. Referring to FIGS. 3A and 3B, a first set 62 of apertures 60 are located on one arm covering portion 30 while a second set 64 of apertures 60 are located on the other arm covering portion 30. As seen in FIG. 3A, the gripping portion 44 passes out of the outer shell 25 between and through the first set 62 of apertures while the other gripping portion 44 passes out of the outer shell 25 between and through the second set 64 of apertures 60. Referring to FIGS. 4A and 4B, an alternative location for the first and second sets 62, 64 of apertures 60 is shown. In this embodiment, the first and second sets 62, 64 are located on the shoulder covering portions 34. While this embodiment is shown with the drag harness 40 having gripping loops 52, it should be understood that other drag harnesses 40 illustrated in FIG. 3B may also be used wherein the first and second sets 62, 64 of apertures are located on the shoulder covering portions and the drag harness 40 of FIG. 4B can also be used with the first and second sets 62, 64 of apertures when located on the arm covering portions 30. Furthermore, it should be understood that the apertures 60 may be located elsewhere on the protective garment 20.

FIG. 1 depicts gripping loops 44 located on the arm covering portions 30 and also depicts gripping loops 44 in phantom located on the shoulder covering portions 34 indicating an alternative position for the gripping portions 44. However, it should be understood that the protective garment 20 may include more than two gripping portions 44, such as by including the gripping portions 44 illustrated in phantom. Similarly, the drag harness 40 can include an additional gripping portion 70, such as shown in FIGS. 3A and 4A along the center line 36. In one form, the gripping portion 70 is a pull strap. In other forms, the gripping portion 70 can be a handle or loop. Furthermore, the gripping portion 70 may also be substantially covered or enclosed within a pocket or flap 72 when not in use. However, it should be understood that the gripping portion 70 need not be covered or enclosed within the pocket or flap 72 when not in use.

The drag harness 40 may also include further features and structure such as a fastener 74. In one form, the fastener 74 comprises a spring biased hook 76 and a D-ring 78 whereby the wearer may engage the hook 76 and D-ring 78 to secure the drag harness 40. However, it should be understood that the drag harness 40 need not include the fastener 40. Furthermore, other forms of fasteners are contemplated as understood by those skilled in the art.

The drag harness 40 may also be utilized in other protective garments, including the pants 24. In this form, the drag harness 40 includes two wearer portions 42 and at least two gripping portions 44 wherein one wearer portion and at least one gripping portion is located within each leg covering portion 32. One form of the gripping portion 44 is illustrated by gripping portion 80 wherein the gripping portion extends between two apertures 60. An alternative form of the gripping portions 44 is illustrated by gripping portion 82 whereby each gripping portion 82 extend out of and back within a single aperture 60. The gripping portions 44 each extends from a leg covering portion 32 at a mid-leg location between the top and bottom of the wearer's legs, and in this case at the knee location. The pants 24 may also include addition features such as pockets 84 which may be utilized to enclose the gripping portions 80,82. The pockets 84 can be used to prevent the gripping portions 80,82 from being snagged and/or abraded when the wearer is moving around. The pockets 84 can include releasable fasteners 86, such as hook and loop fasteners, so that the pocket may be opened and/or removed so a rescuer can more easily grasp the gripping portions 80,82. The pockets 84 can also serve as knee pads.

The drag harness 40 can be used whereby one or more rescuers can drag and/or carry the wearer. In a non-deployed state, the gripping portions 44 are positioned close to the protective garment 20 and/or are enclosed within a pocket or flap, such as with pants 32. This prevents the gripping portions 44 from being abraded and/or getting caught on external surfaces. The gripping portions 44 may be grasped by one or more rescuers such that the gripping portions will extend away from the outer shell 25 in a deployed state. In this state, the wearer portion 42 will tighten against the wearer's body to more securely engage the wearer. It should be understood that any number of rescuers may be used to drag and/or carry the wearer. Furthermore, multiple drag harnesses 40 may be used in combination, such as one drag harness in the coat 30 and one drag harness in the pants 32. In one form, such as with the embodiment in FIG. 1, five rescuers may be used to carry the wearer wherein a rescuer is located at each leg, each arm and behind the wearer's head to grasp a gripping portion 44, 80, 82, 70.

It should be understood that the drag harness 40 may be sewn into a layer of the protective garment. In another form, the drag harness may also be releasably secured within the protective garment by a variety of fastening means known by those skilled in the art, such as snaps, hook and loop fasteners and the like. The protective garment 20 and drag harness 40 may be made from a variety of materials. Furthermore the protective garment 20 and drag harness 40 may be made of the same or different materials. In one form, the drag harness 40 is made of fire resistant material, such as Nomex® or Kevlar®). However, it should be understood that a variety of other materials may be used. Furthermore, the drag harness 40 may be made of a rope-type material, a web-type material and other forms understood by those skilled in the art. Additionally, the gripping loops 52 can be of different materials than the wearer loop 50. Similarly, the drag harness 40 may be made of different materials based upon the location of the drag harness 40 on the wearer's body. For example, the gripping portions 44 may be made of different materials than the wearer portion 42.

It should be appreciated that for all of the disclosed embodiments there are many possible modifications. Additionally, it should be understood that the embodiments described herein may be utilized in conjunction with one another or separately.

The invention claimed is:

1. A protective garment for a firefighter or emergency worker comprising:

an outer shell having a main body portion and at least two limb covering portions; and a drag harness located substantially within the outer shell, the drag harness comprising a wearer portion configured to encircle a portion of a wearer's body within the outer shell, and at least two gripping portions, a first gripping portion located at a first limb covering portion, a second gripping portion located at a second limb covering portion, each of the gripping portions located adjacent the outer shell in a non-deployed state and extend away from the outer shell in a deployed state whereby a rescuer can drag a wearer;

wherein the garment is a protective coat having arm covering portions and the gripping portions extend from apertures in the arm covering portions.

2. The protective garment of claim 1 wherein each of the gripping portions comprise gripping loops located adjacent the outer shell in a non-deployed state and extend away from the outer shell in a deployed state whereby a rescuer can drag a wearer.

3. The protective garment of claim 1 wherein the apertures comprise a first set of apertures and a second set of apertures.

4. The protective garment of claim 3 wherein the first gripping portion passes out of the outer shell through a first one of the first set of apertures and back into the outer shell through a second one of the first set of apertures while the second gripping portion passes through a first one of the second set of apertures and back into the outer shell through a second one of the second set of apertures.

5. The protective garment of claim 4 wherein each of the apertures is defined by a grommet located on the outer shell.

6. The protective garment of claim 1 wherein the drag harness comprises a webbing material.

7. The protective garment of claim 1 wherein the drag harness comprises a rope material.

8. The protective garment of claim 1 wherein the drag harness further comprises a releasable fastener whereby the drag harness can be secured around a wearer.

9. The protective garment of claim 1 further comprising an additional gripping portion extending from the main body portion.

10. The protective garment of claim 9 wherein the additional gripping portion is a pull strap.

11. A protective garment for a firefighter or emergency worker comprising:

an outer shell having a main body portion and at least two limb covering portions; and a drag harness located substantially within the outer shell, the drag harness comprising a wearer portion configured to encircle a portion of a wearer's body within the outer shell, and at least two gripping portions, a first gripping portion located at a first limb covering portion, a second gripping portion located at a second limb covering portion, each of the gripping portions located adjacent the outer shell in a non-deployed state and extend away from the outer shell in a deployed state whereby a rescuer can drag a wearer;

wherein the garment is protective pants or coveralls having leg covering portions, the drag harness further comprising two wearer portions, one each within the leg covering portions and the gripping portions extend from the leg covering portions at locations on a wearer's legs between a top and bottom of the legs.

12. A protective garment for a firefighter or emergency worker comprising:

an outer shell having a center line which defines two halves; and a drag harness located substantially within the outer shell, the drag harness comprising a wearer portion and at least two gripping portions, a first gripping portion located at one of the halves, a second gripping portion located at the other of the halves, each of the gripping portions comprising a gripping loop located adjacent the outer shell in a non-deployed state and extend away from the outer shell in a deployed state whereby a rescuer can drag a wearer, each gripping loop comprising a separate elongate component with spaced ends that are attached to the wearer portion, each of the separate elongate components defining a loop shape.

13. The protective garment of claim 12 wherein the outer shell includes a first set of apertures and a second set of apertures.

14. The protective garment of claim 13 wherein the first gripping loop passes out of the outer shell through a first one of the first set of apertures and back into the outer shell through a second one of the first set of apertures while the second gripping loop passes through a first one of the second set of apertures and back into the outer shell through a second one of the first set of apertures.

15. The protective garment of claim 14 wherein each of the apertures is defined by a grommet located on the outer shell.

16. The protective garment of claim 12 wherein the drag harness comprises a webbing material.

17. The protective garment of claim 12 wherein the drag harness comprises a rope material.

18. The protective garment of claim 12 wherein the drag harness further comprises a releasable fastener whereby the drag harness can be secured around a wearer.

19. The protective garment of claim 12 wherein the garment is protective pants or coveralls having leg covering portions, the drag harness further comprising two separate wearer portions, one each within the leg covering portions and the gripping portions extend from the leg covering portions.

20. The protective garment of claim 12 further comprising an additional gripping portion extending from the center line.

21. The protective garment of claim 20 wherein the additional gripping portion is a pull strap.

22. The protective garment of claim 12 wherein the spaced ends of one of the gripping loops are attached to the wearer portion at spaced locations.

23. The protective garment of claim 12 wherein the spaced ends of one of the gripping loops are slidably coupled to the wearer portion.

24. A protective garment for a firefighter or emergency worker comprising:

an outer shell having a center line which defines two halves; and a drag harness located substantially within the outer shell, the drag harness comprising a wearer portion configured to encircle a portion of a wearer's body within the outer shell, and at least two gripping portions, a first gripping portion located at one of the halves, a second gripping portion located at the other of the halves, each of the gripping portions comprising a gripping loop located adjacent the outer shell in a non-deployed state and extend away from the outer shell in a deployed state whereby a rescuer can drag a wearer, each gripping loop being a separate loop that is connected to the wearer portion;

wherein the garment is a protective coat having arm covering portions and each of the gripping loops extend from a pair of apertures in a corresponding one of the arm covering portions.

25. A protective garment for a firefighter or emergency worker comprising:

an outer shell having a center line which defines two halves; and a drag harness located substantially within the outer shell, the drag harness comprising a wearer portion configured to encircle a portion of a wearer's body within the outer shell, and at least two gripping portions, a first gripping portion located at one of the halves, a second gripping portion located at the other of the halves, each of the gripping portions comprising a gripping loop located adjacent the outer shell in a non-deployed state and extend away from the outer shell in a deployed state whereby a rescuer can drag a wearer, each gripping loop being a separate loop that is connected to the wearer portion;

wherein the garment is a protective coat having shoulder covering portions and each of the gripping loops extend from a pair of apertures in the shoulder covering portions.

26. The protective garment of claim 25 wherein each gripping loop comprises an elongate component that is separate from the other elongate component and the wearer portion and connected to the wearer portion so that each elongate component defines a loop shape.

* * * * *